US007056235B2

(12) United States Patent
MacDonald

(10) Patent No.: US 7,056,235 B2
(45) Date of Patent: Jun. 6, 2006

(54) ALTERNATIVE GOLF CLUB AND METHOD OF USING THE SAME

(76) Inventor: Christopher J. MacDonald, 1880 N. El Camino Real, #6, San Clemente, CA (US) 92672

( * ) Notice: Subject to any disclaimer, the term of this patent is extended or adjusted under 35 U.S.C. 154(b) by 201 days.

(21) Appl. No.: 10/299,569

(22) Filed: Nov. 18, 2002

(65) Prior Publication Data

US 2004/0018888 A1 Jan. 29, 2004

Related U.S. Application Data

(60) Provisional application No. 60/399,107, filed on Jul. 27, 2002.

(51) Int. Cl.
*A63B 57/00* (2006.01)
*A63B 53/04* (2006.01)

(52) U.S. Cl. ..... 473/409; 473/390; 473/396; 473/324

(58) Field of Classification Search ..... 473/387, 473/400, 402, 419, 217, 231, 249, 256, 324, 473/336, 559, 563, 417
See application file for complete search history.

(56) References Cited

U.S. PATENT DOCUMENTS

| | | | | |
|---|---|---|---|---|
| 1,064,916 A | | 6/1913 | Kelly et al. | |
| 2,527,906 A | * | 10/1950 | Bennett et al. | 473/417 |
| 3,048,399 A | * | 8/1962 | Breitbach | 473/457 |
| 3,720,410 A | * | 3/1973 | Saytar | 473/562 |
| 3,743,297 A | | 7/1973 | Dennis | |
| 3,759,527 A | | 9/1973 | Witherspoon | |
| 3,817,534 A | | 6/1974 | Carlino | 273/168 |
| 3,975,024 A | | 8/1976 | Stephan | |
| 3,999,765 A | * | 12/1976 | Bishop | 473/238 |
| 4,179,147 A | | 12/1979 | Mendenhall | 294/50.7 |
| 4,195,842 A | | 4/1980 | Coleman | 273/171 |
| 4,725,062 A | | 2/1988 | Kinney, III | |
| 5,133,553 A | * | 7/1992 | Divnick | 473/245 |
| 5,199,713 A | | 4/1993 | Kinoshita | |
| 5,385,343 A | * | 1/1995 | Davis, Sr. | 473/452 |
| 6,383,086 B1 | | 5/2002 | Flood | |
| D464,386 S | * | 10/2002 | Weng | D21/725 |

FOREIGN PATENT DOCUMENTS

JP 2001346926 A * 12/2001

OTHER PUBLICATIONS

"Transform Your Game", D'Lance Golf. www.dlancegolf.com.*
"Golf Tips Archives", Tommey Knocker Golf Products. copyright 1998.*
"Instruction is the Key to Retaining Golfers", Nov. 2003, www.pgamagazine.com, pp. 38 and 39.
Florida Golf News; "Teaching Reaches New Heights"; vol. 8; No. 3; Mar., 2003.

* cited by examiner (Continued)

*Primary Examiner*—Eugene Kim
*Assistant Examiner*—Alvin A. Hunter, Jr.
(74) *Attorney, Agent, or Firm*—Richard C. Litman

(57) ABSTRACT

An improved golf training system and method of using the system is provided. The golf training system may also be used as a new game. The system includes a golf club having an enlarged hitting surface and shorter shaft, and a tee that comes in variable extended lengths. By gradually and incrementally lowering the length of the tee and extending the length of the club, a player is able to learn proper swing mechanics.

6 Claims, 10 Drawing Sheets

ALTERNATIVE GOLF CLUB AND METHOD OF USING THE SAME

RELATED APPLICATIONS

This application claims priority to U.S. Provisional Application No. 60/399,107, filed on Jul. 27, 2002, which is hereby incorporated by reference.

BACKGROUND OF THE INVENTION

1. Field of the Invention

The present invention relates to sporting devices and, in particular, to an improved golf swing training device and a method of using the device.

2. Description of the Related Art

The game of golf has always had its followers, but in recent years, interest in the sport has dramatically increased. The game's difficulty and expensive equipment, however, represent significant barriers to people's participation.

For decades, if not centuries, golf club manufacturers have focused their technological advances on making the ball go farther and straighter when hit. Club manufacturers know that many golfers will spend thousands of dollars on new advances in equipment. They realize that many players are looking to "buy" skill. However, a golf club will only perform as well as the person swinging it. Unfortunately, these technological advances have done little to make the ball substantially easier to hit. Today's golfers are using virtually the exact same clubs used by PGA stars. These golfers are expected to go to the golf course, learn the game and perform well. This is unrealistic considering the enormous difficulty of the game as currently played. It is unfair and impractical to expect people who have a minimal amount of time to devote to practice to perform effectively with these clubs.

Golf's two biggest barriers to entry are: (1) the game's difficulty and (2) the expense. The two biggest reasons people play golf are: (1) the satisfaction of hitting a ball and (2) socializing.

The golf swing consists of a synchronized motion around the axis of the spine. When a person is standing upright, their head, shoulders, arms, hips, legs and feet are in a relaxed, natural and comfortable position. When a right-handed person is given a golf club and looks down at the ball, the golfer must tilt their spine angle, drop their right shoulder lower, lean forward at the hips and look down at the ball. This tilting, dropping, leaning and looking down disrupts the natural relationship between the head, shoulders, arms, hips, legs and feet. The body now is in an unnatural or "disoriented" position. This creates many problems because each part of the body now becomes "disoriented" and independent relative to the other body parts. When one of those body parts moves independently from the other parts during a golf swing, there is a "disconnection" in the swing. The golfer must re-educate each body part to perform in a synchronized way. This is a reason why the game can be so frustrating and difficult. It is also why the golf swing is so difficult to learn.

Three major factors make a golf ball very difficult to hit. They are: 1) the size of the club face, 2) the length of the club and 3) the position of the ball.

Therefore, there exists a need for an improved golf training device and particularly for a training device which effectively and inexpensively trains a player for playing golf with a traditional golf club.

SUMMARY OF THE INVENTION

In accordance with one embodiment of the present invention, a golf club is provided. The golf club includes a generally elongated shaft having a longitudinal axis, and a club head having at least one axis, a vertical midpoint, and an enlarged planar hitting surface. In some embodiments, the hitting surface is symmetric about the vertical midpoint, and the axis of the club head is parallel to the longitudinal axis of the shaft.

In some embodiments, the shaft can be about 12–47 inches in length. In one embodiment, the club is about 34 inches in length. In some embodiments, the club head can have a mass of about 300–600 g. In one embodiment, the club head has a mass of about 335 g. In some embodiments, the club is adapted for both right-handed and left-handed use, or ambidextrous use. The hitting surface can be circular.

In accordance with another embodiment of the present invention, a golf system is provided. The golf system includes a golf club and a tee. The club can include a club head having an enlarged hitting surface and a short shaft. A golf ball is hit off of the tee using the club. In certain embodiments, the club has a length of about 18–50 inches. In one embodiment, the club is about 34 inches in length. In some embodiments, the hitting surface is circular. In some embodiments, the tee has a height of about 12–60 inches.

In accordance with another embodiment of the present invention, a method of learning golf is provided. The method includes choosing a first tee having a first length, choosing a club, hitting a ball off of the tee using the club, whereby a player learns proper swing mechanics. In some embodiments, the club head has at least one axis, a vertical midpoint, and an enlarged planar hitting surface that is symmetric about the vertical midpoint, the shaft has a longitudinal axis. The at least one axis of the club head can be parallel to the longitudinal axis of the shaft.

In some embodiments, the first tee has a height of about 34 inches. These embodiments can also include choosing a second tee having a height of about 24 inches, wherein a player hits the ball off of the second tee. These embodiments can also include a third tee having a height of about 14 inches, wherein a player hits the ball off of the third tee. In some embodiments, the method can include choosing a plurality of tees of varying lengths, and decreasing the tee height as training progresses. In one embodiment, the first tee is telescoping. In some embodiments, the length of the first tee varies. In other embodiments, a plurality of tees of varying lengths can be provided, such that a player learns to play golf by gradually starting with a tee at a height lower than the height of the first tee to a tee at ground level. The tee can be telescoping. In some embodiments, the club can include an enlarged hitting surface, and have a mass of about 300–600 g.

In accordance with another embodiment of the present invention, a method of learning golf is provided. The method includes providing at least a first tee and a club having an enlarged hitting surface, and hitting a ball off of the first tee using the club, whereby a player learns proper swing mechanics.

In accordance with another embodiment of the present invention, a method of playing a game is provided. The method includes placing a tee having a height of about 12–60 inches in the ground, and hitting a ball off of the tee with a club having an elongate shaft having a longitudinal axis and a club head having an axis passing through the center of mass of the club head. In some embodiments, the longitudinal axis of the shaft and the axis of the club head are collinear.

In accordance with another embodiment of the present invention, a golf club having an elongated shaft and a club head is provided. The club head can have an enlarged round hitting surface, and the plane of the hitting surface is parallel with a longitudinal axis passing through the shaft.

In accordance with another embodiment of the present invention, a method of learning golf is provided. The method includes gradually and incrementally decreasing the tee height and incrementally increasing the club length. The tee height and golf club length may be varied simultaneously. The club can be adapted for both right-handed and left-handed use.

For a better understanding of the present invention, reference is made to the detailed description taken in conjunction with the accompanying drawings and the appended claims.

DETAILED DESCRIPTION OF THE PREFERRED EMBODIMENTS

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1B:
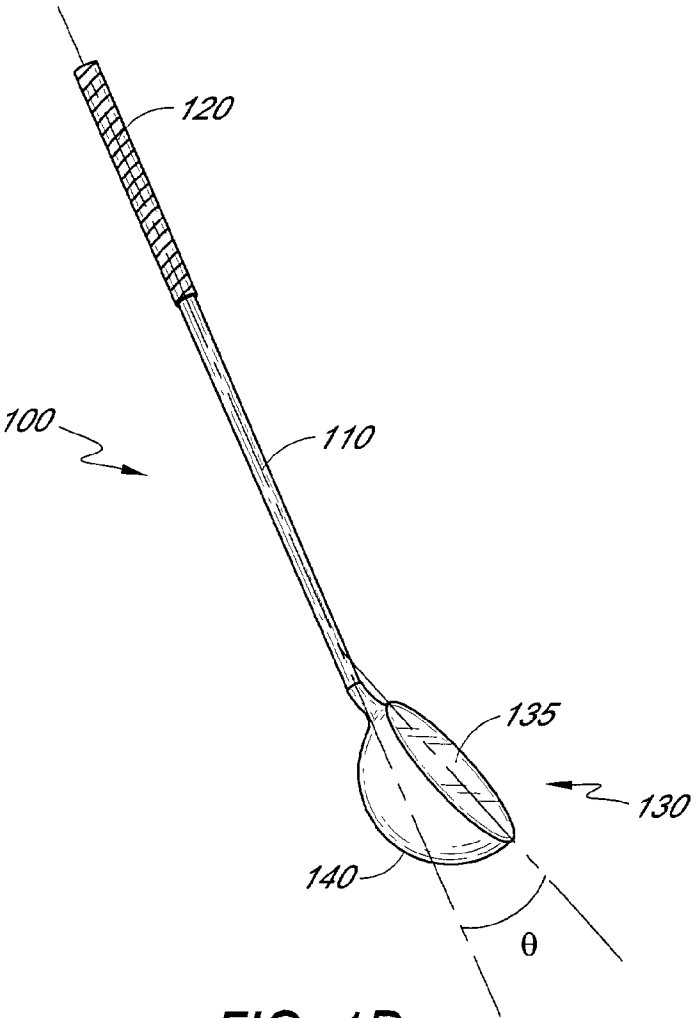
FIG. 1B is a perspective view of an alternative golf club in accordance with certain other embodiments of the present invention.
Figure 1A:
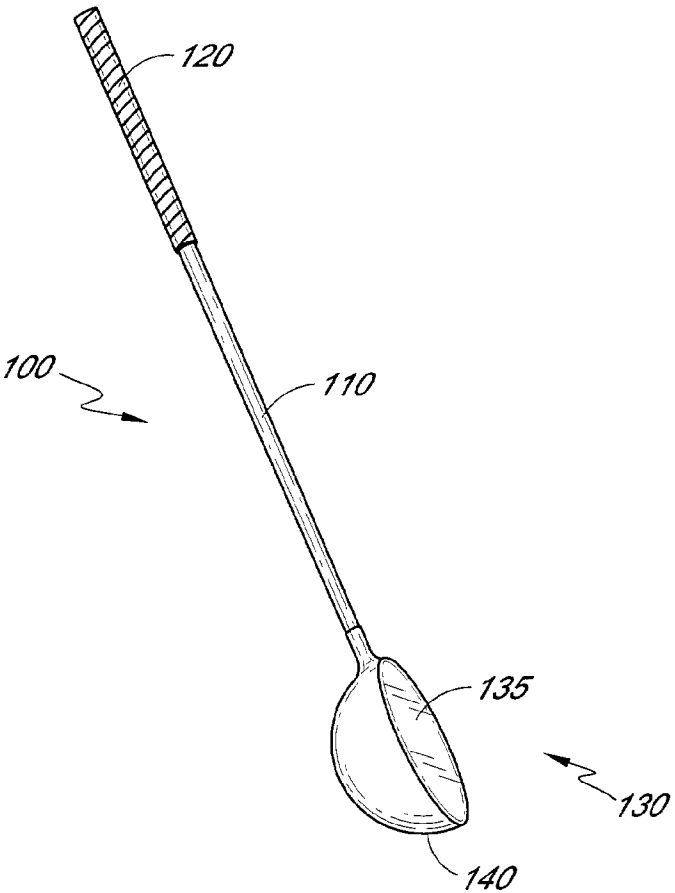
FIG. 1A is a perspective view of an alternative golf club in accordance with certain embodiments of the present invention.

Referring to FIG. 1A, there is illustrated one embodiment of the golf club 100 in accordance with certain embodiments of the present invention. Certain embodiments of the present invention relate to a golf training system. However, other embodiments relate to the general sporting and entertainment aspects of golf.

The golf training system described herein offers the golfer the opportunity to learn golf from the "top down". This "top down" approach to teaching the modern swing will yield quicker results and success. Today's modern swing mechanics require that the golfer keep the club in front of the body. This position keeps the club from getting trapped behind the golfer where all sorts of problems occur. Many of golf's finest instructors accurately describe the golf swing as similar to a baseball swing, but on a different plane. Common swing problems such as: "head lifting", "hips swaying", the "reverse pivot", "arm swing", "flat swing","upright swing" and more, can all be identified and corrected with the present system. For good players, the system will help identify swing flaw tendencies or "disconnections" when things go bad. One "disconnection" occurs when golfers lift their heads when they swing.

The present system enables the golfer to quickly feel the benefit of synchronizing the shoulders, hips and legs around the spine axis in developing proper swing mechanics. By placing the ball on an elevated tee closer to eye level, the player may assume a much more natural position and be taught proper swing mechanics in a more relaxed and enjoyable format.

In some embodiments, as illustrated in FIG. 1A, a golf club 100 having a shaft 110, grip 120 and club head 130 is provided. The golf club 100 can be used as a training device or for playing. The overall club length can be from about 18 inches to 50 inches. In some embodiments, the shaft 110, grip 120, and club head 130 all lie along a common longitudinal axis. In some embodiments, as shown in FIG. 1B, the club head 130 can be oriented such that the club head 130 is at an angle with respect to the longitudinal axis of the shaft 110. The angle can be acute (0–90°), obtuse (90–180°), or reflex (180–360°). In some embodiments, the club maintains vertical symmetry about the longitudinal axis of the shaft 110.

In one embodiment, the shaft 110 of the club is straight and has a circular cross-section. However, other cross-sectional shapes can be used, such as polygonal, elliptical, octagonal and other round shapes. The shaft can be made of a metal, such as steel, but any other materials can be used. Examples of materials that can be used include titanium, graphite, hard plastics, polymers, composites, other metals, or combinations thereof.

The grip 120 is similar to a grip used with traditional golf clubs. The grip 120 has a cylindrical shape and includes a tubular opening, having an inner diameter adapted to receive the shaft 110. In many embodiments, the inner portion of grip 120 is adapted to the shape of shaft 110. Accordingly, if shaft 110 has a non-circular cross-section, at least the inner tubular portion also has a corresponding or complimentary cross-section. The grip 120 can be molded to the shape of the hands. The grip 120 can be made of rubber, leather, or other materials.

Figure 2:
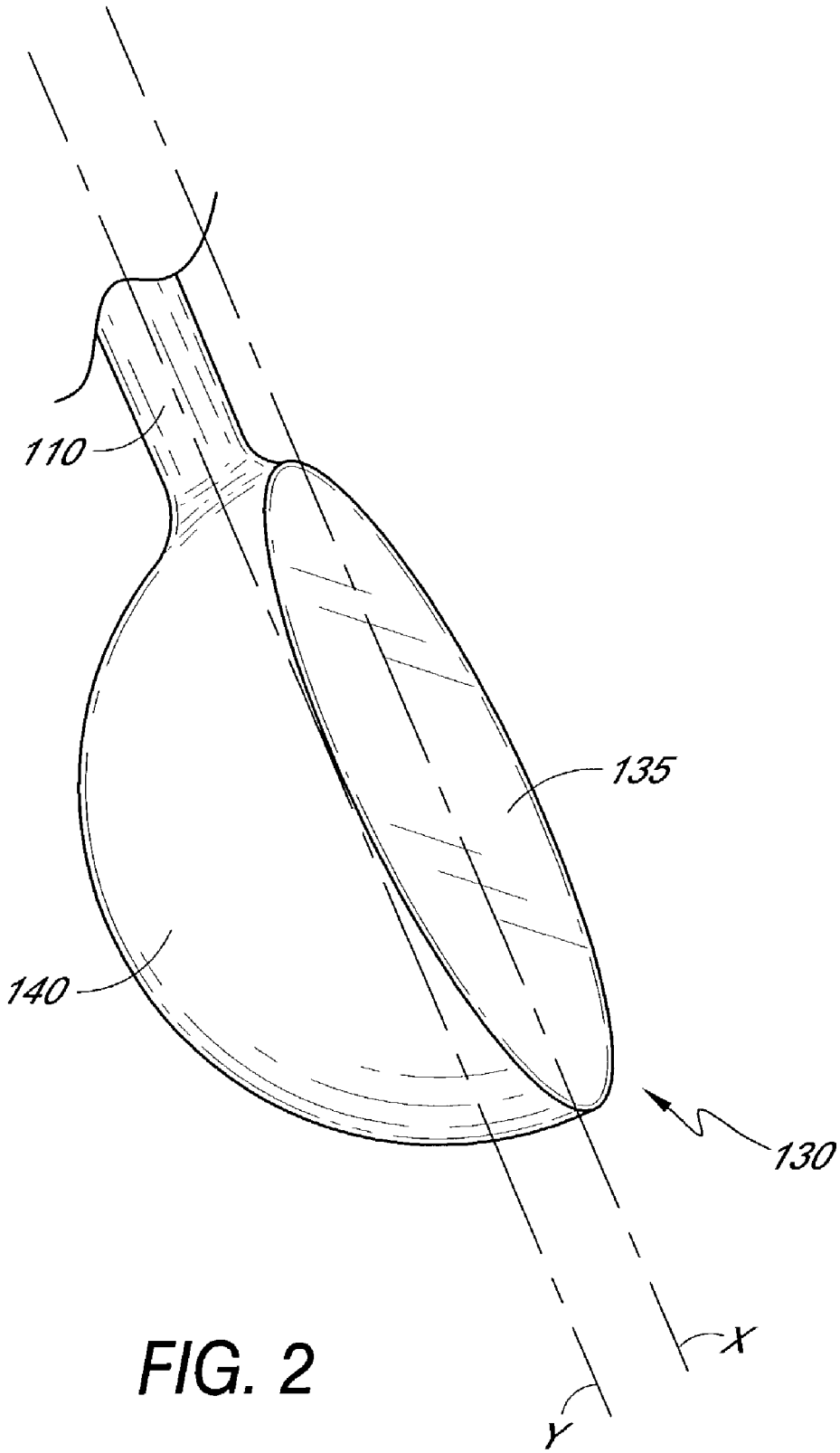
FIG. 2 is a perspective view of the head of the golf club of FIG. 1A.
Figure 3A:
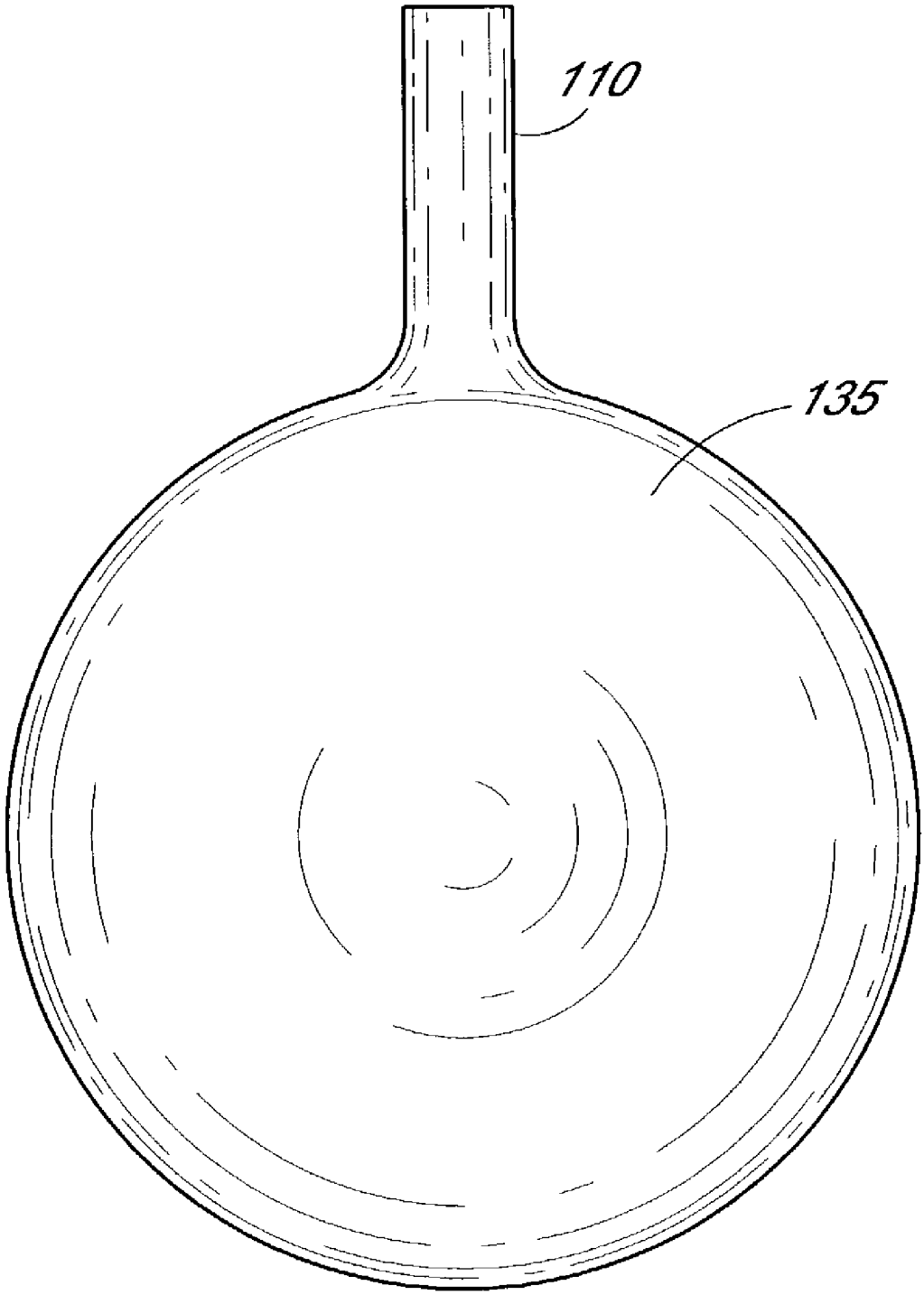
FIGS. 3A–B are front views of the head of the club of FIG. 1A.
Figure 3B:
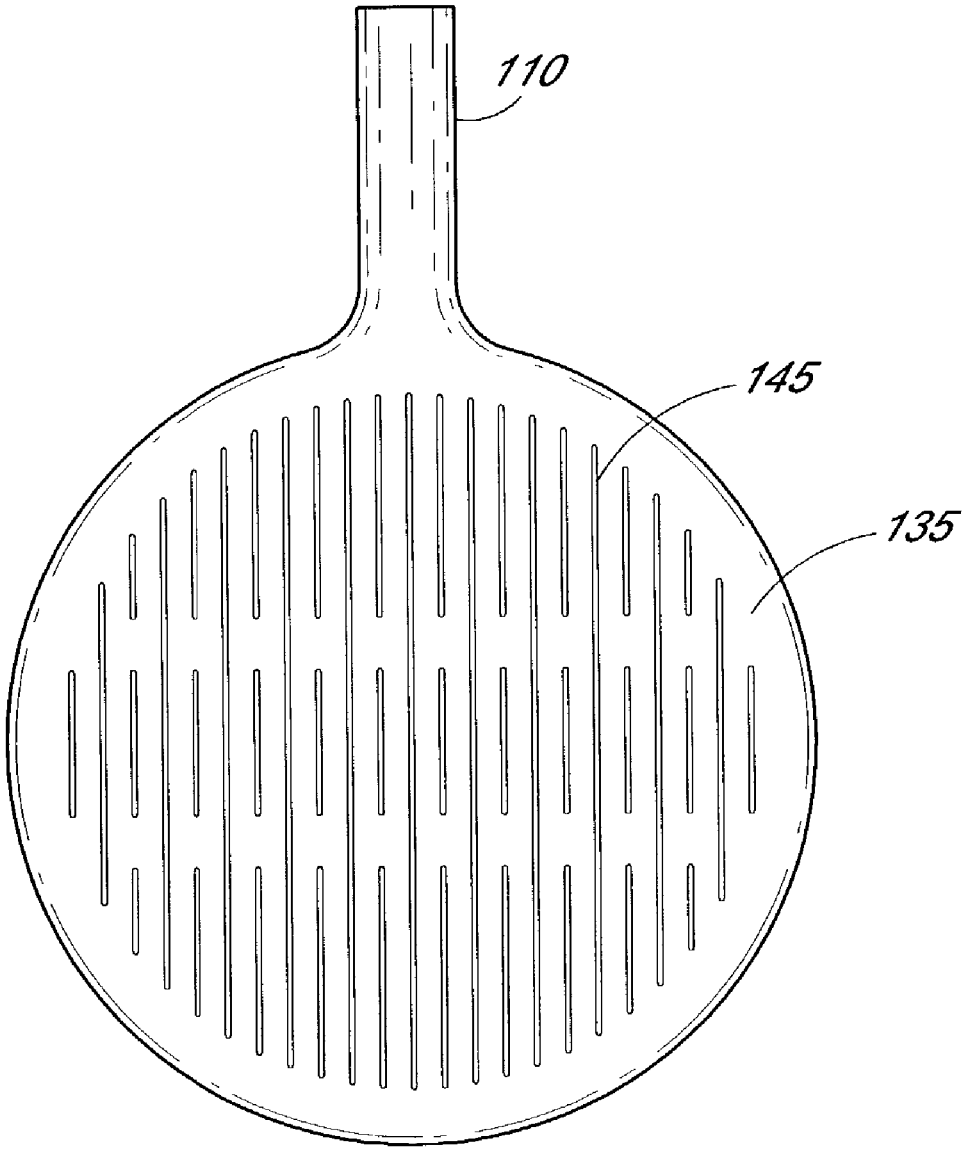
Figure 4:
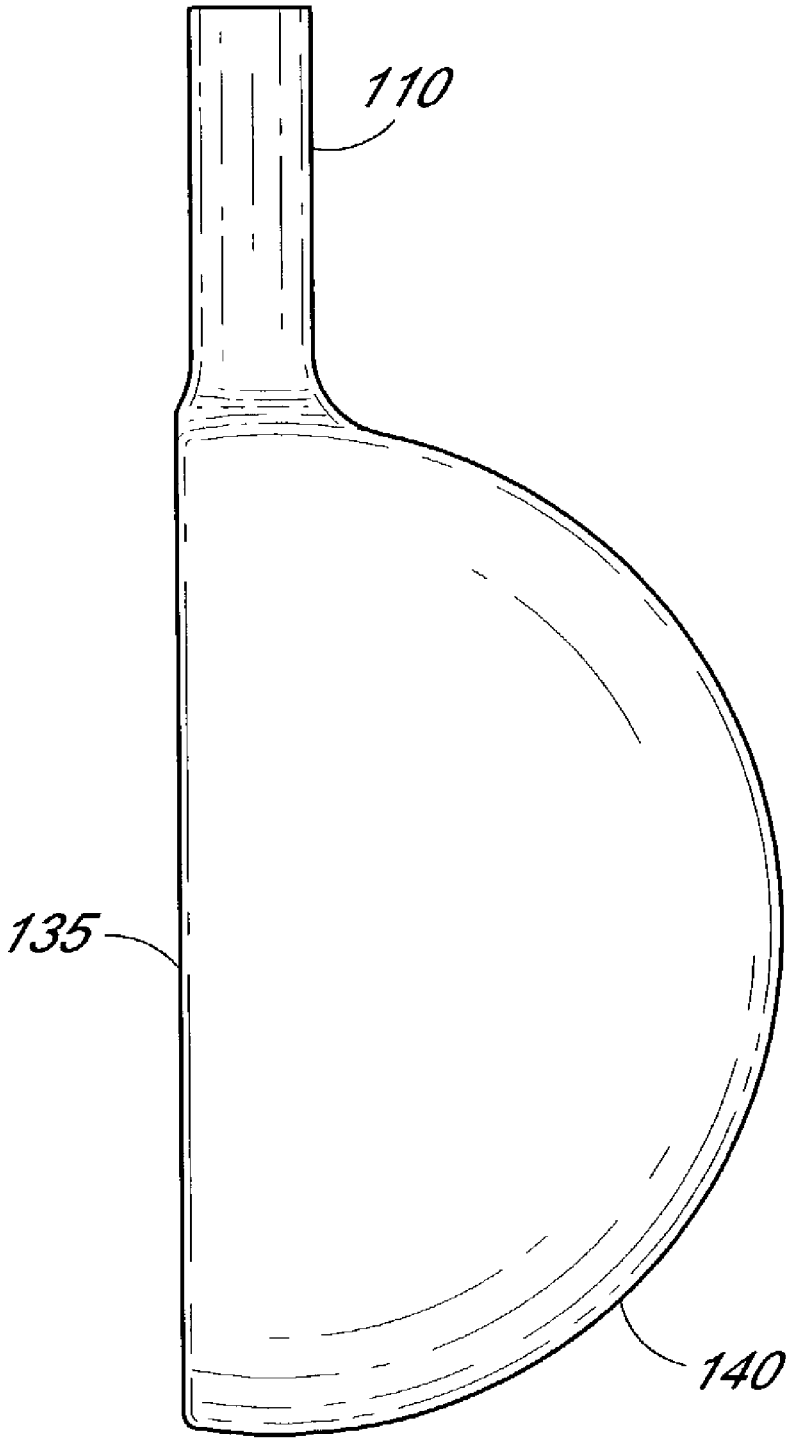
FIG. 4 is a side view of the head of the club of FIG. 1A.

With reference to FIGS. 2–4, the club head 130 is shown in detail. In the embodiments illustrated by FIGS. 3A, 3B, and 4, the club head 130 can have a circular club face 135 and a hemispherical back 140. The club face 135 can be in a plane that is positioned parallel to the longitudinal axis passing through shaft 110, grip 120, and club head 130. Other shapes can also be used for club face 135, such as polygonal, elliptical, octagonal and other curved or non-curved shapes.

Club head 130 includes a number of axes, X and Y in FIG. 2. In some embodiments, at least one axis X of the club face 135 is parallel to the longitudinal axis which passes through shaft 110. The club face 135 also includes a vertical midpoint. In some embodiments, the club face 135 is symmetrical about the vertical midpoint. In certain embodiments, the club head 130 is symmetrical about the vertical midpoint. In many embodiments, the same club can be used by either left- or right-handed players. In one embodiment, at least one axis Y passes through the center of mass of the club head 130. In this embodiment, the axis passing through the center of mass of the club head 130 can be collinear with the longitudinal axis of the shaft 110.

The face 135 of the club may also include a surface treatment 145, which can be decorative and/or functional, as shown in FIG. 3B. Examples of surface treatments 145 include scoring, cladding, plating and coatings, although other surface treatments can be used as well. The surface treatment 145 can be provided on the club face 135 using any manufacturing techniques available. The surface treatment 145 can be provided on the club face 135 for improved alignment of the club head 130. Additionally, the surface treatment 145 can be provided on the club face 135 for improved energy transfer to the ball or for improved spin. The club head 130 can be made of a metal, such as, for example, steel, stainless steel, aluminum, titanium or combinations thereof. Examples of other materials include hard plastics, polymers, composites, and combinations thereof, however, other materials can also be used. The materials used to make the club head 130 can be disposed in either a homogeneous or heterogeneous manner throughout. In homogenous embodiments, the club head 130 is made of the same material throughout. In heterogeneous embodiments, a combination of materials can be used to form club head 130 and may be individually and discretely located in the club head 130 to optimize material and mechanical effects of the club head 130. For example, the club face 135 can be made of one material, while the hemispherical back 140 can be made of another material, or combinations of materials.

The diameter of the face 135 can range from about 3–6 inches in some embodiments, and about 4–5 inches in other embodiments. The total volume of the club head 130 can range from about 300–600 cc, and is about 340 cc in one embodiment. The club head 130 has a mass ranging from about 300–600 g in some embodiments, and is about 335 g in one embodiment. The values provided are merely exemplary, however, and the dimensions and mass of the club head 130 can vary significantly to improve the ease of use and stability of the club.

The additional weight of the club head and shorter length of the club shaft provide improved stability in many embodiments. By shortening the length and increasing the mass, the club 100 has a lower moment of inertia about the longitudinal axis of the player's spine. The club 100 is easier to swing because the moment of inertia about the axis passing through the player is lower. The club 100 has a higher moment of inertia about a longitudinal axis passing through the length of the club. The ability of a club head 130 to resist twisting during off-center hits is desirable, especially to recreational golfers, who frequently make contact away from the center of the club face 135. A club with a low moment of inertia about the axis passing through the club tends to twist open or closed depending on the contact location, and the direction of the shot suffers. A higher moment of inertia makes the club head 130 more resistant to twisting, resulting in a generally straighter shot. The enlarged hitting surface 135 also improves a players ability to hit the ball.

The club 100 can be made from any manufacturing methods for producing golf clubs, such as forging, molding, brazing, welding, and/or casting, although other manufacturing techniques can be used as well. Forging involves producing a golf club head from a series of forging dies, and stamping the head to a final shape. Forged heads are typically made of softer metals than cast heads and can require hand finishing and chrome plating. Compression molding is typically used with composite materials. Molding involves layering graphite or other materials and heat curing the layers to create a club head. In some embodiments, the grip 120 can be attached to the shaft 110 using compression fit techniques. In certain embodiments, adhesives can also be used to apply the grip 120 to the shaft 110. Alternatively, the grip 120 can be formed with the shaft 110. In one embodiment, the shaft 110 can be removably attached to the club head 130.

Figure 5A:
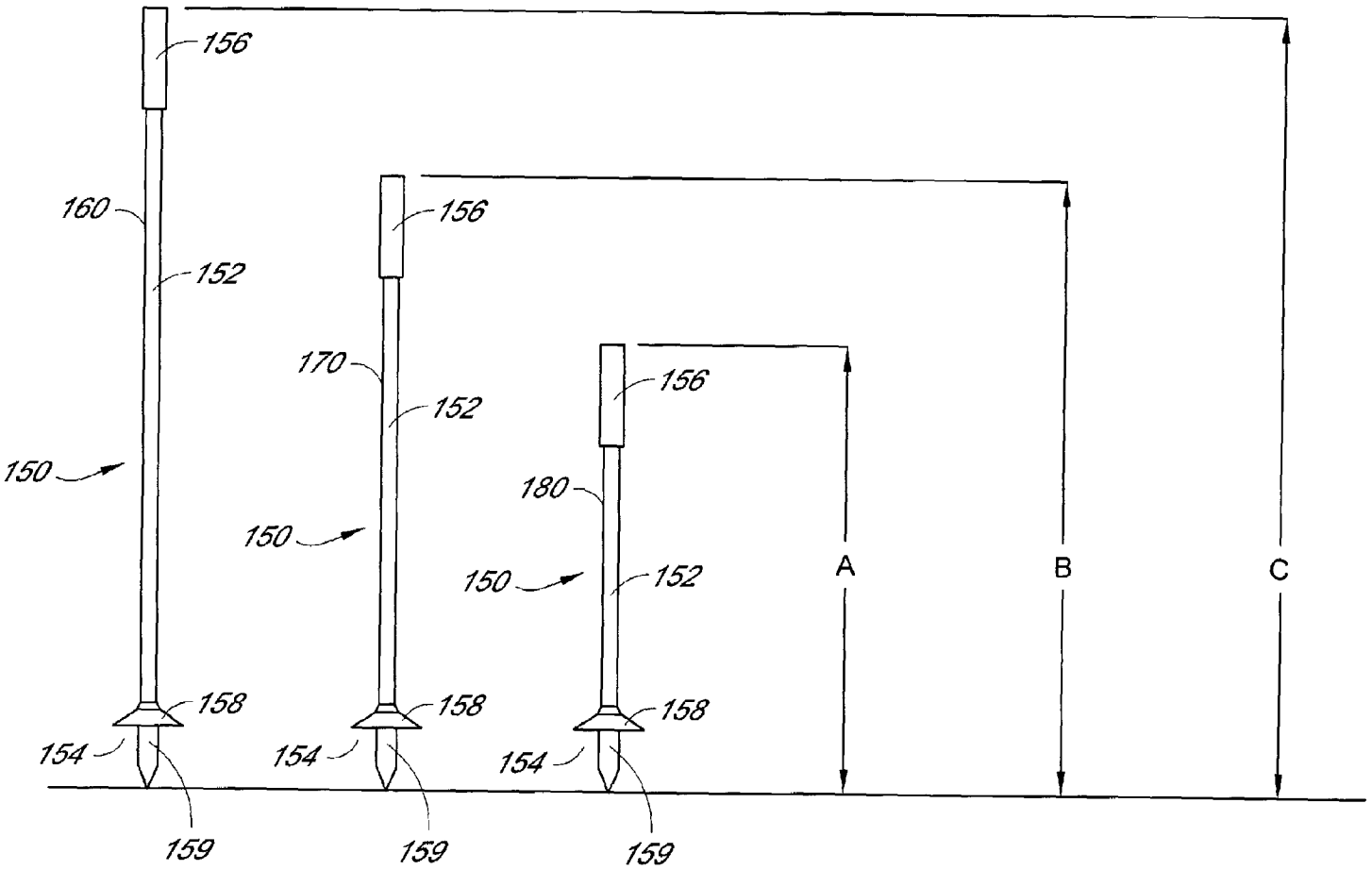
FIG. 5A is a side view of adjacent tees of varying heights in accordance with certain embodiments of the present invention.
Figure 5B:
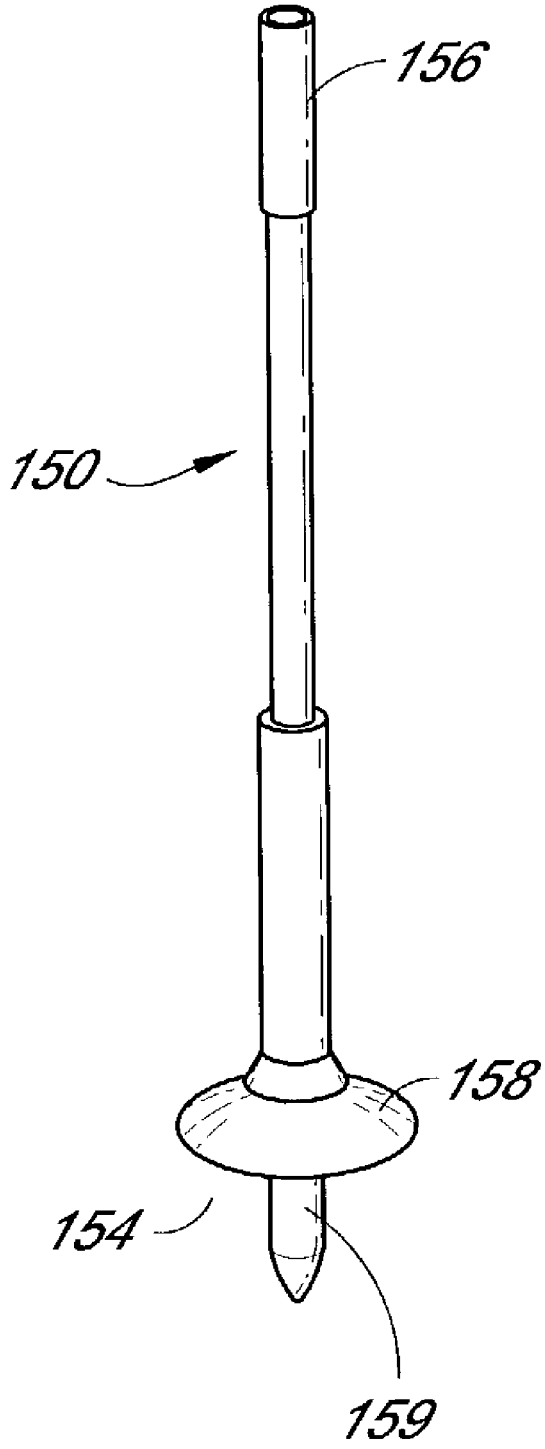
FIG. 5B is a perspective view of a telescoping tee in accordance with certain embodiments of the present invention.

With reference to FIG. 5A, in accordance with certain embodiments, a tee 150 is provided. The tee preferably includes a shaft 152, tip 154, and tee top 156. The tee 150 can come in at least three different sizes: beginner 160, intermediate 170, and advanced 180, but more or fewer sizes can be used, as will be described in detail hereinafter. The terms "beginner", "intermediate", and "advanced" are used only for descriptive purposes and are not intended to be limiting. In some embodiments, as shown in FIG. 5B, the tee 150 can be telescoping, such that a single tee may provide varying height levels. Any method of producing a telescoping effect for a rod or tube can be used in such embodiments.

The shaft 152 of the tee is generally straight and can have a circular cross-section. However, other cross-sectional shapes can be used, such as such as polygonal, elliptical, octagonal and other curved or non-curved shapes. In some embodiments, the shaft 152 can be curved. The cross-sectional diameter can vary as well, such that the diameter is greater at the tip 154 and smaller at the tee top 156, or vice versa. In certain embodiments, the shaft 152 is made of a metal, such as steel or titanium, but other materials, such as graphite, composites, polymers, hard plastics, or combinations thereof can be used. The length of shaft 152 is variable as described below.

Tip 154 is located at the bottom end of shaft 152. Tip 154 can include a base 158 and an extension 159. The base 158 can be circular and can have a wider diameter than both the extension 159 and the shaft 152. Any other shape that provides stability can be used. The base 158 provides structural support to the tee 150, such that the tee 150 has stability when placed in the ground. The extension 159 can be tapered at its bottom-most portion, such that the tip easily enters the ground and is of adequate length to provide stability and remain in the ground. In use, the extension 159 is within the ground, while the base 158 is just above the ground, resting on the surface.

Tee top 156 can be a tubular member which fits over the top end of shaft 152. In many embodiments, the tee top 156 is a resilient material, such as rubber. Tee top 156 provides flexibility to the tee 150, such that there is minimal movement of the shaft 152 and tip 154 when the club 100 hits a ball and, possibly, the tee 150.

In certain embodiments, each part of the tee 150 is formed separately, and assembled using compression fit techniques. The shaft 152 and tip 154 can be manufactured as an integral unit, with the tee top 156 assembled using compression fit techniques. Other methods, such as, for example, welding, brazing, and adhesives can be used to secure the shaft 152, tip 154, and tee top 156 together.

In one embodiment, the beginner tee 160 is about waist high. In certain embodiments as illustrated in FIG. 5A, the tee is about 34 inches in length, shown by height C. The beginner tee 160 is designed to get the golfer acclimated to hitting the ball in a more natural "hit zone." In one embodiment, the second or intermediate tee 170 is about 24 inches in length, shown by height B. The intermediate tee 170 allows the golfer to hit the ball with more power as a more vertical swing develops. The golfer should try to hit the ball on a slight upswing. In one embodiment, the third or advanced tee 180 is about 14 inches in length, shown by height A. The advanced tee 180 allows the golfer to hit the ball with power as the swing advances to a more vertical attack. In many embodiments the tees 150 vary in height from about 12–60 inches.

By providing a number of tees 160, 170, and 180 of varying lengths, a player is able to gradually adjust their swing level as their skills progress. The player may start at the beginner tee 160, and work down to the intermediate tee 170, and then to the advanced tee 180, such that proper swing mechanics are developed gradually, however, any number of different heights can be used. The gradual variation in tee height allows a player to adjust from a first swing, which is similar to a baseball swing, to a traditional golf swing.

Figure 6:
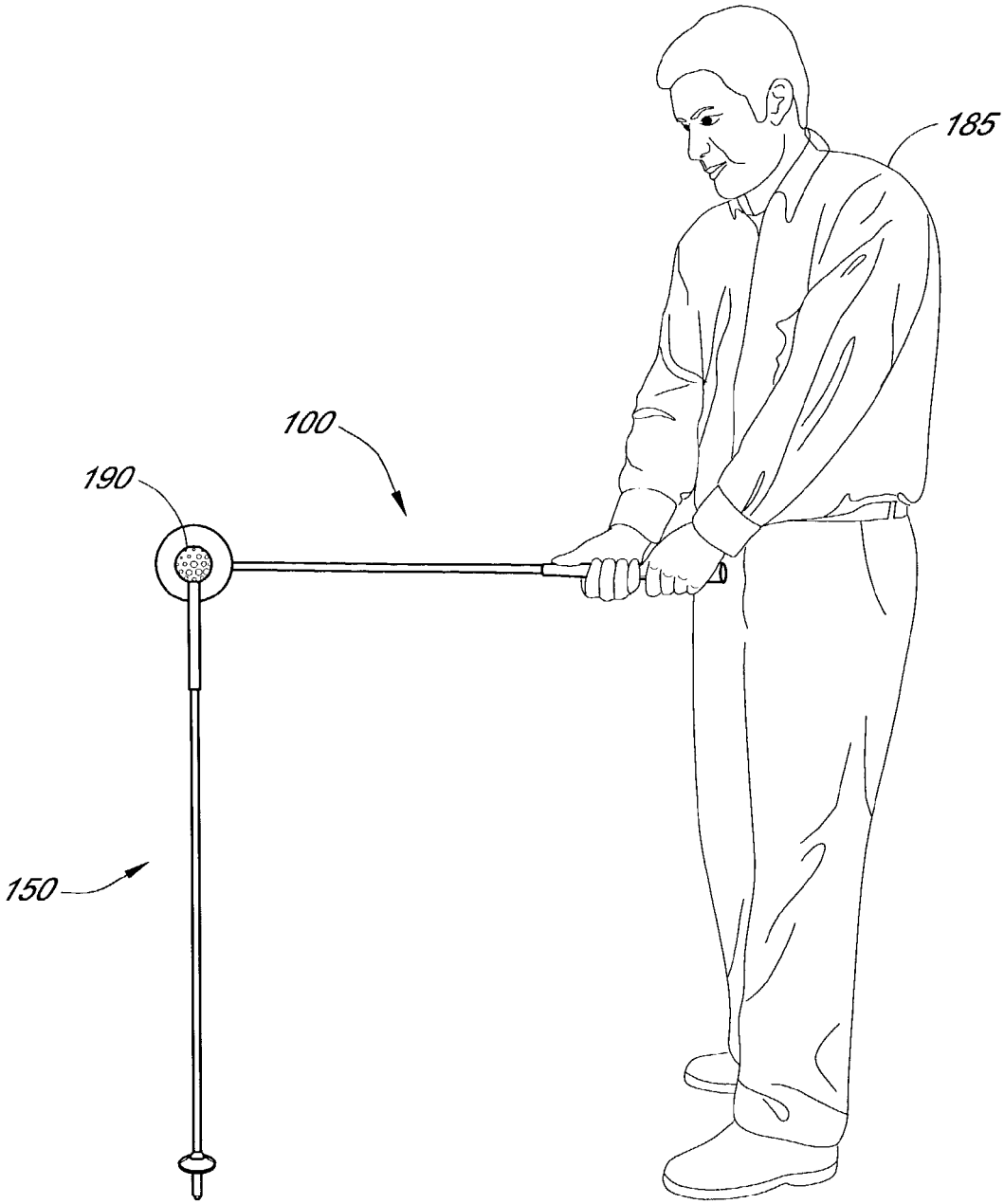
FIG. 6 is a diagram of a player using the combined golf club and tee system of certain embodiments wherein the tee is at waist level.
Figure 7:
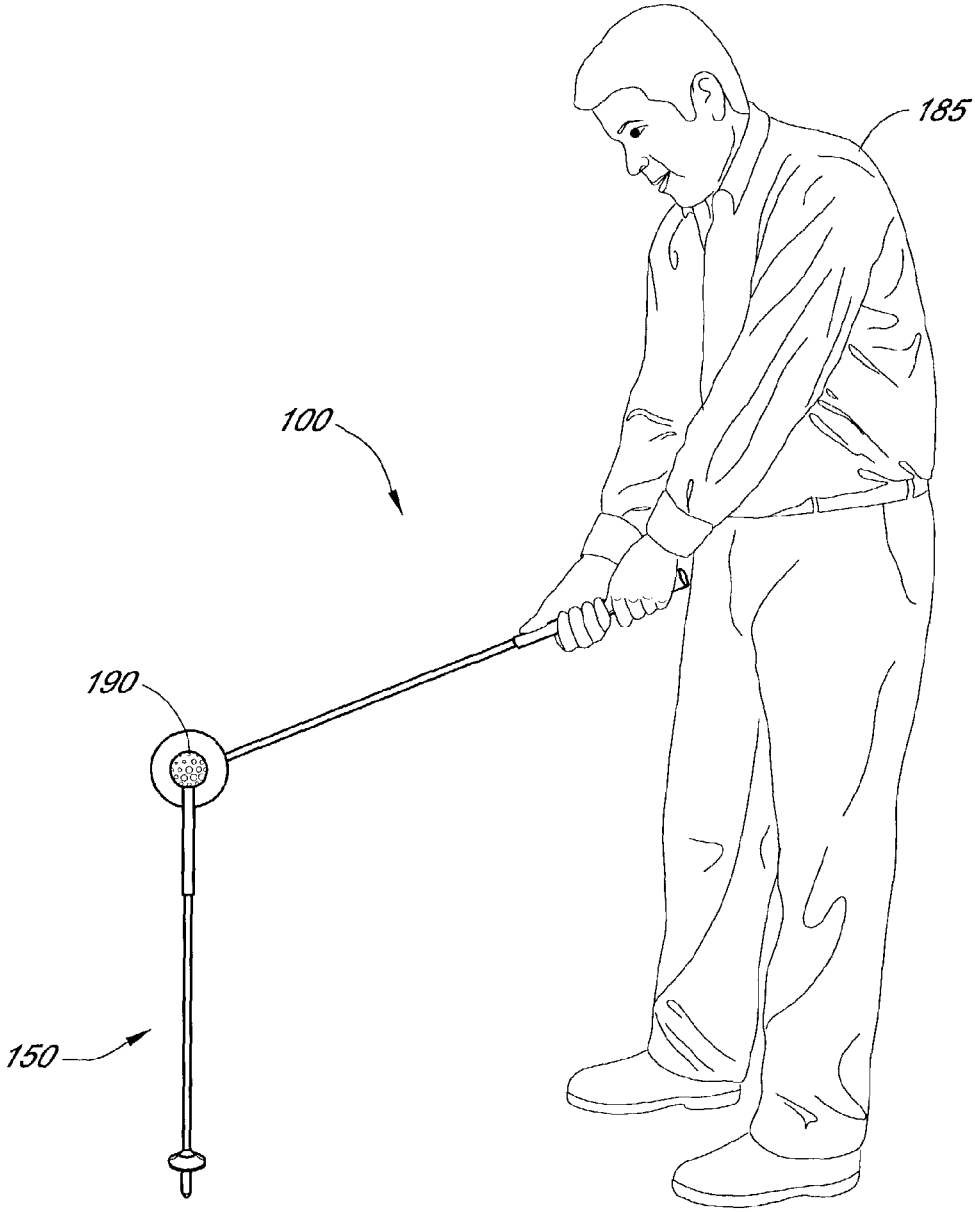
FIG. 7 is a diagram of a player using the combined golf club and tee system of certain embodiments wherein the tee is at a lower level as skill progresses.
Figure 8:
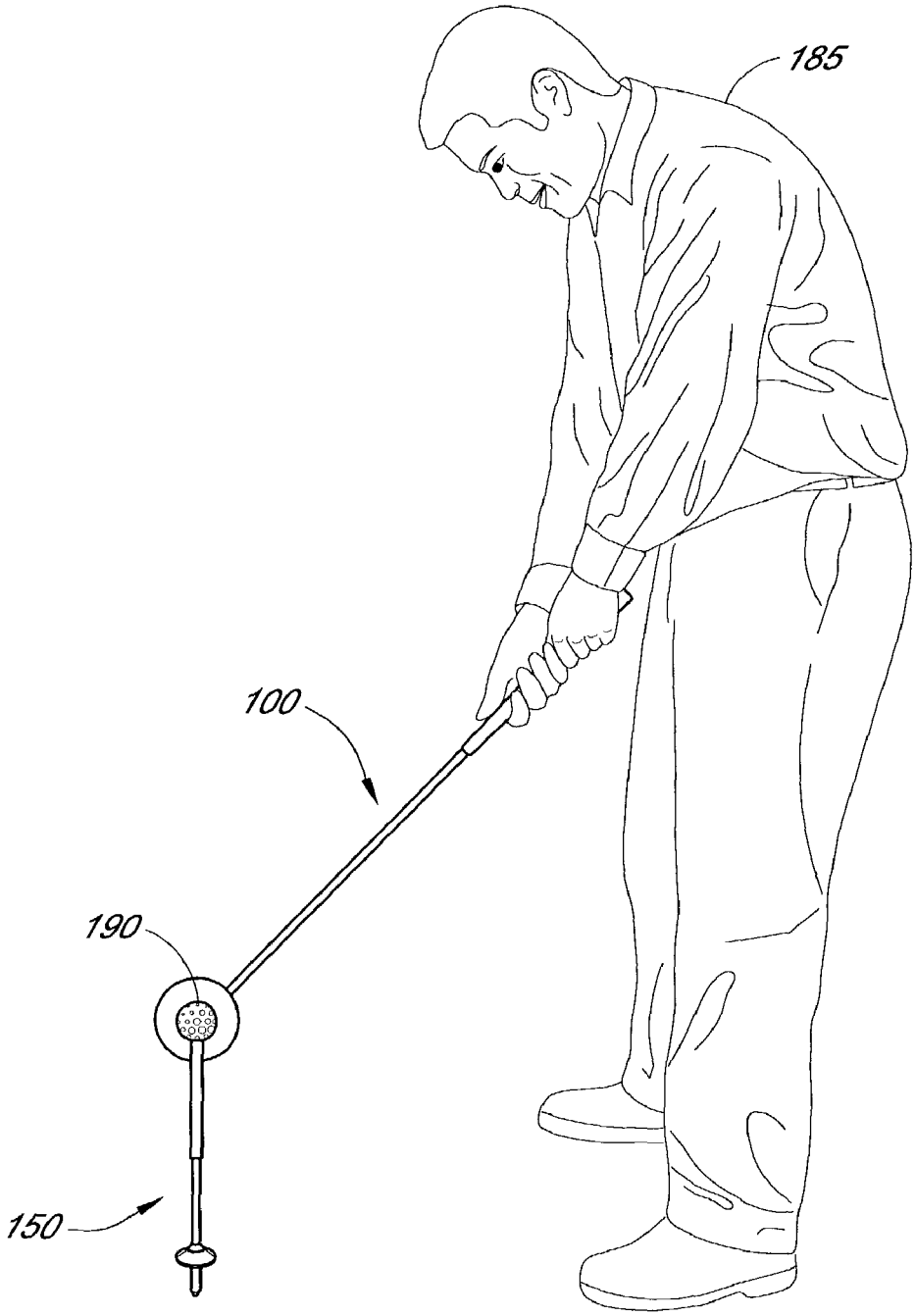
FIG. 8 is a diagram of a player using the combined golf club and tee system of certain embodiments wherein the tee is at an even lower level as skill further progresses.

Referring to FIGS. 6–8, the method of using the club 100 and tee system 150 are shown. The height of the tee, and thus the ball level is shown gradually and incrementally lowering in FIGS. 6–8. By gradually reducing the height of the tee from the beginning tee 160, to the intermediate tee 170, to the advanced tee 180, the player gradually steps down from a first swing, which is similar to baseball and comes more naturally to players, to a golf swing.

FIG. 6 shows a player 185 using the club 100 and a beginner tee 160 to hit a ball 190. FIG. 7 shows a player 185 using the club 100 and an intermediate tee 170 to hit the ball 190. FIG. 8 shows a player 185 using the club 100 and an advanced tee 180 to hit the ball 190.

The length of the club 100 can also be adjusted. The club length can be adjusted simultaneously with the adjustment of the tee height. Alternatively, a player can adjust between tees 160, 170, and 180 using the same length club 100, and subsequently increase the length of club 100.

The tee 150 should be firmly implanted into the ground, unless other methods of supporting the tee 150 are provided. In some embodiments, which are not shown, the tee 150 includes a tip 154 which permits the tee 150 to support itself on the ground without being implanted.

An example of how to play using the equipment described herein will now be explained.

In certain embodiments, the player tees off using their club 100 with the tee 150. Subsequent shots can be played by placing the tee 150 in the general vicinity where the ball lies, such as directly behind, in front of, on the side of the ball, or any other desirable location. The player can use the tee 150 anywhere on the course, including bunkers and hazards. The ball can be lifted and placed on the tee 150 and hit again, until the green is reached. In some embodiments, when on the green, the player uses the club 100 as a traditional putter, without the tee. However, the club 100 can be used without a tee 150 at any other location as well.

In certain embodiments, the beginner tee 160 can be used for shots around the green. The player can choke up on the club 100 and open the face 135 towards the sky to decrease the distance the ball travels. In this position, the ball can be hit high and soft for improved control. In some embodiments, the golfer can try to hit "line drives" that fly straight and preferably about 60–100 yards off the tee 150.

The club 100 helps golfers focus on developing proper swing fundamentals and eye-hand coordination. The club design of some embodiments more than doubles the club face hitting area of the club 100 compared to that of existing club face hitting areas. Also, the club 100 has a decreased shaft length, which reduces the "swing arc" and makes the club 100 easier to control. Furthermore, the tee 150 puts the ball in a more natural position to be hit with a swing similar to baseball or tennis. By placing the ball closer to eye level, the player's eye-hand coordination is improved. The benefits of these advances can be immediate and enormous. The ball is more easily hit, thereby enhancing the individual's experience, making the game more enjoyable.

Embodiments of the club 100 and tee 150 also make the game less frustrating and physically demanding. The system accelerates the pace of the game, while maintaining the essence, tradition and competitive elements that have made golf one of the country's most popular sports.

With the system described herein, the golfer learns to keep their eyes on the ball. Another example of a common "disconnection" would be the "swaying" of one's hips. This is a major flaw for many amateurs. By swinging embodiments of the club 100 as described herein, a player is able to identify and correct flaws in his swing mechanics. With the systems and methods as described herein, a player cannot sway off the ball without feeling the problem. After a short time, the lower body should reconnect to the normal swing and swing mechanics should return to normal. The training system enables golfers to quickly re-center their swing around the "spine" axis of the spine.

The golf training system described herein: (1) places the ball closer to eye level in a more natural position to be hit with a swing similar to that used in baseball or tennis; (2) more than doubles the club face hitting area; and, (3) decreases the length of the club 100, which reduces the "swing arc", making the club easier to control. By gradually reducing the height of the ball on the tee, the player is able to comfortably step down to a traditional golf swing.

The golf training system described herein provides many advantages. The golf training system makes the ball easier to hit and accelerates playing time, which results in more time spent socially with family and friends. The golf training system also reduces anxiety, humiliation, fear, and intimidation. The system provides a great teaching aid by accelerating and encouraging players to learn proper swing mechanics. The club also provides for better ball control. The same club can be used by both right and left handed players. Many embodiments of the club may be used for all shots including putts, so that only one club is required during an entire game, although more than one club can be used. Existing golfers may use the system to work on their mechanics. The system can also result in an expansion of the golfing public, because of the reduced cost, reduced frustration and improved efficiency. Furthermore, older or injured players will be able to prolong their golfing careers or even learn the game for the first time.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A method of improving a golf swing of a golfer, comprising:

providing a tee at a first height of at least 12 inches and a golf ball thereon, wherein the tee being one of a single adjustable-height tee and multiple different-height tees;

providing a golf club to be used by the golfer, wherein the golf club comprises a shaft having a first end and a second ends a grip surrounding the first end of said shafts and a club head attached to the second end of said shaft, wherein the club head has at least one axis, a vertical midpoint, and a hemispherical shape with an enlarged circular planar hitting surface that is symmetric about the vertical midpoint, and wherein the shaft has a longitudinal axis, and the at least one axis of the club head is parallel to the longitudinal axis of the shaft;

swinging with a substantially horizontal swing and hitting the golf ball off the tee at the first height using the golf club by the golfer;

reducing the tee height of the tee to a second height less than the prior swing and providing a golf ball thereon;

swinging with a less than horizontal swing and hitting the golf ball off of the tee at the second height using the golf club by the golfer;

continuing to repeat the steps of reducing the height of the tee and providing a golf ball thereon, swinging with a less than horizontal swing to compensate for the lower tee height, and hitting the golf ball off of the tee at the reduced tee height using the golf club by the golfer;

whereby gradually reducing the height of the tee height and swinging with a less than horizontal swing to compensate for the reduced tee height enables the golfer to re-center his or her swing around the axis of their spine, and comfortably step down from a substantially horizontal swing similar to a baseball swing to a more vertical golf swing.

2. The method of claim 1, wherein the tee includes a first height of about 34 inches so that the golfer hits the golf ball with a substantially horizontal swing when swinging and hitting a golf ball off the tee at the first height.

3. The method of claim 2, wherein the tee includes a second height of about 24 inches.

4. The method of claim 3, wherein the tee includes a third height of about 14 inches.

5. The method of claim 1, wherein the tee includes a collinear shaft and tee top.

6. The method of claim 1, wherein said club head of the golf club has a mass of about 300–600 g.

* * * * *